US006354798B1

(12) United States Patent
Deckers

(10) Patent No.: US 6,354,798 B1
(45) Date of Patent: Mar. 12, 2002

(54) BLADE FOR A FLUID-FLOW MACHINE, AND STEAM TURBINE

(75) Inventor: Mathias Deckers, Dorsten (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/521,397

(22) Filed: Mar. 8, 2000

Related U.S. Application Data

(63) Continuation of application No. PCT/DE98/02556, filed on Aug. 31, 1998.

(30) Foreign Application Priority Data

Sep. 8, 1997 (DE) ..... 197 39 318

(51) Int. Cl.[7] ..... F04D 29/24; F04D 29/54
(52) U.S. Cl. ..... 415/192; 416/223 R
(58) Field of Search ..... 415/191, 192, 415/208.1; 416/223 R, 223 A

(56) References Cited

U.S. PATENT DOCUMENTS

| | | | | |
|---|---|---|---|---|
| 4,682,935 A | * | 7/1987 | Martin | 416/223 A |
| 4,714,407 A | * | 12/1987 | Cox et al. | 415/192 |
| 4,826,400 A | * | 5/1989 | Gregory | 415/181 |
| 5,067,876 A | * | 11/1991 | Moremann, III | 416/219 R |
| 5,203,676 A | * | 4/1993 | Ferleger et al. | 416/223 A |
| 5,947,683 A | * | 9/1999 | Kobayashi | 415/208.1 |
| 6,036,438 A | * | 3/2000 | Imai | 415/192 |
| 6,071,077 A | * | 6/2000 | Rowlands | 416/223 A |
| 6,195,983 B1 | * | 3/2001 | Wadia et al. | 416/223 R X |

FOREIGN PATENT DOCUMENTS

| | | |
|---|---|---|
| DE | 1168599 | 4/1964 |
| DE | 2841616 | 10/1980 |
| DE | 3148995 A1 | 8/1982 |
| DE | 4228879 A1 | 3/1994 |
| EP | 0425889 A1 | 5/1991 |
| EP | 0441097 A1 | 8/1991 |
| EP | 0661413 A1 | 7/1995 |
| EP | 0704602 A2 | 4/1996 |

OTHER PUBLICATIONS

Published International Application No. 96/14494 (Sharma et al.), dated May 17, 1996.

"Advanced Steam Turbine Technology for Improved Operating Efficiency", R.B. Scarlin, Power–Gen Europe 1995, Amsterdam RAI, The Netherlands, pp. 229 ff.

"Modern Blade Design for Improving Steam Turbine Efficiency" M. Jansen et al., VDI Berichte, No. 1185, 1995, pp. 277–291.

"Development of Three–Dimensional Stage Viscous Time Marching Method for Optimisation of Short Height Stages", G. Singh et al., VDI Berichte No. 1185, 1995, pp. 157–179.

* cited by examiner

*Primary Examiner*—John E. Ryznic
(74) *Attorney, Agent, or Firm*—Herbert L. Lerner; Laurence A. Greenberg; Werner H. Stemer

(57) ABSTRACT

A blade for a fluid-flow machine is directed along a blade axis. Cross-sectional profiles which are disposed at a distance from one another axially and at right angles to the blade axis are offset from one another equidirectionally in each case in a root end region and in a tip end region of the blade towards a center region, so that the blade is displaced in a bulged manner along the blade axis. Furthermore, cross-sectional profiles at a distance from one another axially are twisted relative to one another in the root end region and/or in the tip end region. A steam turbine is also provided.

10 Claims, 3 Drawing Sheets

BLADE FOR A FLUID-FLOW MACHINE, AND STEAM TURBINE

CROSS-REFERENCE TO RELATED APPLICATION

This application is a continuation of copending International Application No. PCT/DE98/02556, filed Aug. 31, 1998, which designated the United States.

BACKGROUND OF THE INVENTION

FIELD OF THE INVENTION

The invention relates to a blade for a fluid-flow or turbo machine being directed along a blade axis and having a root end region, a tip end region and a center region disposed therebetween along the blade axis, and a cross-sectional region at right angles to the blade axis. The invention also relates to a steam turbine, in particular a high-pressure or intermediate-pressure steam turbine.

The efficiency of a fluid-flow machine, in particular of a steam turbine, is reduced by flow losses which occur. An improvement in the efficiency and thus also a reduction of such flow losses is dealt with, for example, in an article entitled "Advanced Steam Turbine Technology for Improved Operating Efficiency" by R. B. Scarlin, in "Power-Gen Europe 95", May 16–18, 1995, Amsterdam RAI, the Netherlands, Book 2, Vol. 4, page 229 ff. The development of three-dimensional turbine blades with regard to various flow losses, such as gap losses, losses due to the blade profile, and losses in the end regions of the turbine blade (end wall losses), is described in that article. An inclination of the turbine blade in the circumferential direction is specified in order to reduce the last-mentioned losses. An inclination of the turbine blade in the region of the blade tip as well as in a hub region of the turbine blade leads to a bent blade, in which case such a bend, due to the mechanical properties, can only be used in guide blades. Furthermore, it is stated globally in the article that twisting of the blade also has an effect on the inclination of the blade, so that the blade inclination, the blade twist as well as the blade profile are available in a three-dimensional structure in the end regions of the blade.

European Patent Application EP 0 704 602 A2, corresponding to U.S. Pat. No. 5,779,443, concerns the structure of a turbine guide blade in an intermediate stator of a steam turbine directed along a turbine axis. The blade in that case extends along a radially directed blade axis and has a pressure side and a suction side as well as an inlet edge and an outlet edge. In that case the blade is shaped along the radial direction in such a way that the pressure side has a convex curvature from a blade root region to a blade tip region lying opposite the blade root region along the blade axis.

In a particularly preferred structure, the curvature is achieved by a setting angle (bitangential angle) on radially successive, cross-sectional profiles at a distance from one another being varied parabolically with respect to the turbine axis by an appropriate rotation of the cross-sectional profiles about a fixed common outlet edge. In this way, the channel width for the steam can be reduced in the blade tip region and in the blade root region and can be increased in a blade center region lying therebetween. That leads to a shifting of part of the steam mass flow, away from the two loss-affected marginal regions of the turbine guide blade.

An increase in the efficiency of a steam turbine, in particular of a high-pressure or intermediate-pressure steam turbine, is likewise dealt with in an article entitled "Modern Blade Design for Improving Steam Turbine Efficiency" by M. Jansen and W. Ulm in "VDI Berichte" No. 1185, 1995, pages 277–290. The effect of various flow losses for various steam turbines is explained therein. A reduction in the flow losses is achieved by a special configuration of the turbine blade. In that case, the three-dimensionally constructed turbine blades have an inclination in a root region and a tip region of the turbine blade. In the article, a comparison is made between the flow losses of those three-dimensionally constructed turbine blades and entirely cylindrical blades.

Such cylindrical blades have pressure and suction sides parallel to the blade axis and therefore have neither a twist nor an inclination. So-called twisted turbine blades, which have an increasing twist and a changing blade profile over their height, are described as a further alternative to the three-dimensionally constructed turbine blades.

German Published, Non-Prosecuted Patent Application DE 31 48 995 A1 describes an axial-flow turbine, such as a steam turbine or a gas turbine, with a multiplicity of guide blades disposed at a distance from one another along the circumference. The guide blades being used are twisted over their height and have a changing inlet angle. The changing of the inlet angle increases continuously in an overlinear manner in the region of the tip of the guide blade, as from a certain height measured from the blade root. The twisting likewise increases continuously over the height of the guide blade. The cross-sectional profile of the guide blade changes continuously from the blade root to the blade tip, with the guide blade becoming increasingly slender. Further changes concerning the outlet angle, the size and the shape of the guide blade are taken into account over the height of the guide blade in the shaping of the guide blade.

German Published, Prosecuted Patent Application 1 168 599 specifies an axial-flow compressor with moving blades and/or guide blades, which have a cross-section that is changed in the region of wall surfaces to compensate for an influence on the flow brought about by those wall surfaces. In the axial-flow compressor, inlet guide blades are disposed along the gas flow path upstream of the moving blades and guide blades. Those inlet guide blades have a convex cross-section, other than in the region of the walls. A middle part of the blade, with the convex cross-section, changes over in each wall region into the un-convex cross-sectional profile in the wall regions in a smooth and constantly curved surface. The cross-sectional profiles of the blade aerofoil consequently change continuously over the height of the inlet guide blade. The inlet angle remains constant over the entire height of the inlet guide blade.

German Published, Prosecuted Patent Application 28 41 616 contains a description of a guide blade rim for an axial-flow turbine with guide blades. The guide blades are disposed between an inner ring and an outer ring and the profile thickness of the blade aerofoil changes proportionally to the blade pitch. In that case the changing of the blade profile over the height of the guide blade does not take place by a change occurring in the shape of the leading edge (pressure side), but instead the projection on the trailing edge gradually increases in size over the height, with a simultaneous increase in the thickness of the guide blade.

The changing of the profile is carried out in that case by an increase in the thickness of the guide blade, while its chord length remains the same. A guide blade rim of that kind can be used in the case of steam turbines, gas turbines and compressors.

German Published, Non-Prosecuted Patent Application DE 42 28 879 A1 specifies an axial-flow turbine having at least one row of curved guide blades. The blade curvature has the effect that both the inlet edge and the outlet edge of the guide blades do not lie in one and the same axial plane. The curvature of the blades in that case runs at right angles to the chord, which is achieved by a displacement of the profile sections both in the circumferential direction and in the axial direction. The guide blades taper from a turbine casing wall (cylinder) to a turbine hub, so that their cross-section changes correspondingly, with the blade profile remaining essentially unchanged over the height of the blade. Apart from the curvature and the tapering, a twisting of the blade aerofoil is also carried out over the blade length of the guide blade, in order to allow for the changing of the circumferential speed of the moving blades following the guide blade over the channel height. Consequently, an adaptation of the blade aerofoil takes place by a deflection of the center of gravity of the profile sections at right angles to the profile chord (curvature or bending), that is to say a simultaneous axial deflection and circumferential deflection, combined with a variation in the chord length.

Turbine blades provided with an inclination for a steam turbine are likewise specified in an article entitled "Development of three-dimensional stage viscous time marching method for optimization of short height stages" by G. Singh, P. J. Walker and B. R. Haller, in "VDI-Berichte" No. 1185, 1995, pages 157–179.

SUMMARY OF THE INVENTION

It is accordingly an object of the invention to provide a blade for a fluid-flow machine, and a steam turbine, which overcome the hereinafore-mentioned disadvantages of the heretofore-known devices of this general type and which have low flow losses.

With the foregoing and other objects in view there is provided, in accordance with the invention, a fluid-flow machine blade directed along a blade axis, comprising a root end region; a tip end region disposed opposite the root end region along the blade axis; a center region disposed between the root end region and the tip end region; a cross-sectional profile at right angles to the blade axis; cross-sectional profiles disposed at a distance from one another axially in direction of the blade axis and offset from one another by a translation in a given cross-sectional direction in the tip end region towards the center region; cross-sectional profiles disposed at a distance from one another axially and offset from one another by a translation in the given cross-sectional direction in the root end region towards the center region; and cross-sectional profiles disposed at a distance from one another axially and twisted relative to one another by a respective differential angle in the root end region and/or in the tip end region.

When a blade is fitted in a turbine having a turbine shaft, the term axially in the direction of the blade axis is synonymous with the term radially relative to the turbine shaft. A reduction in the flow losses in the marginal zones (tip end region, root end region), which are assigned to the hub of a turbine shaft and to the inner periphery of a turbine casing, is achieved by cross-sectional profiles disposed at a distance from one another axially being displaced in the tip end region and in the root end region and by an additional twist in the root end region and/or in the tip end region. The equidirectional displacement towards the center region causes the turbine blade to be inclined (bent) in a bulged manner at right angles to the blade axis. An additional increase in the efficiency, i.e. a reduction in the flow losses, is achieved by an additional twist of the cross-sectional profiles at a distance from one another axially.

In accordance with another feature of the invention, the cross-sectional regions at a distance from one another axially are twisted equidirectionally in the root end region and in the tip end region towards the center region. In this way, the twist is withdrawn again across the entire height of the blade from the tip end region towards the root end region.

In accordance with a further feature of the invention, the blade is constructed for placement in a blade rim which has a circumferential direction, and the cross-sectional direction coincides locally with the circumferential direction. In this way, a bend in the circumferential direction with a simultaneous twist (angular adaptation) in the end regions of the blade is effected in the marginal zones of the blade, as a result of which a reduction in the flow losses and thus an increase in the efficiency of a fluid-flow machine can be achieved. As a result, in particular in steam turbines, an increase in the mechanical output energy with the same thermal energy input is achieved on one hand, and a reduction in the thermal energy input and thus in the environmental pollution due to pollutant discharge, while the output energy remains the same, is achieved on the other hand, as compared with entirely cylindrical or entirely inclined or entirely bent blades.

In accordance with an added feature of the invention, the cross-sectional profiles, during twisting, are twisted relative to their area center of gravity or relative to the blade axis (if different, e.g. due to inhomogeneous mass distribution). The angle of twist which occurs in the process is designated below as a "stagger angle" and execution of the twist is designated as a "stagger-angle change".

In accordance with an additional feature of the invention, in a cross-section at right angles to the blade axis, the cross-sectional profile is identical everywhere along the blade axis. The cross-sectional profile therefore does not change over the height of the blade. In this case, the cross-sectional surface of the cross-sectional profile is also preferably constant. In this case, the blade preferably has a combination of a circumferential deflection of the center of gravity of the cross-sectional profiles (bending in the circumferential direction) and a staggering of the cross-sectional profiles (without changing of the profiling) in the tip end region and root end region (hub region and casing region).

In accordance with yet another feature of the invention, depending on the extent of the blade in the direction of the blade axis (blade length, blade height) relative to the extent of the blade in a direction at right angles to the blade axis (blade width) and on the flow conditions during the use of the blade in a fluid-flow machine, the blade has a cylindrical structure in the center region. The sides (pressure side, suction side) of the blade therefore run parallel to the blade axis.

In accordance with yet a further feature of the invention, the blade is constructed as a guide blade or a moving blade of a steam turbine, in particular of a high-pressure or intermediate-pressure steam turbine. In this case, the blade preferably has a small length-to-width ratio, as is the case in particular in blades for a high-pressure steam turbine.

With the objects of the invention in view there is also provided a steam turbine, in particular a high-pressure or intermediate-pressure steam turbine directed along a turbine axis, comprising an inflow region; an outflow region; a blading region disposed fluidically between the inflow region and the outflow region; and a blade directed along a blade axis and disposed in the blading region, the blade having a root end region, a tip end region, a center region between the end regions, and an inclination and a twist over the blade axis, the inclination and the twist each increasing from the root end region to the center region and decreasing from the center region to the tip end region. With such a configuration of the steam turbine, including the blade with decreasing and increasing inclination and twist, a reduction in the flow losses in the region of a turbine shaft directed along the turbine axis and in the region of a turbine casing surrounding the turbine shaft is achieved.

In accordance with another feature of the invention, the blade with decreasing and increasing inclination and twist is assigned to the inflow region. It is therefore preferably disposed in the first stage and/or the following stages. This applies to stages including a blade rim being formed of moving blades or guide blades. Since, in the first stages of a high-pressure or intermediate-pressure steam turbine, the proportion of so-called secondary losses (marginal losses) in the hub and casing regions is especially high (e.g. up to 30% of the total losses) and is reduced by the blade shape specified, a noticeable increase in the efficiency can thereby be achieved.

In accordance with a further feature of the invention, a twisted blade, i.e. a blade having a twist and change of the cross-sectional profile and/or the cross-sectional surface which increases over its length, is assigned to the outflow region.

In accordance with a concomitant feature of the invention, an entirely cylindrical blade, i.e. having side walls parallel to the blade axis, is provided axially between the stages including the twisted blade and the blade with decreasing and increasing inclination and stagger-angle change. Such a configuration of blades of different geometry provides for a steam turbine which has low flow losses and has high efficiency.

Other features which are considered as characteristic for the invention are set forth in the appended claims.

Although the invention is illustrated and described herein as embodied in a blade for a fluid-flow machine, and a steam turbine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
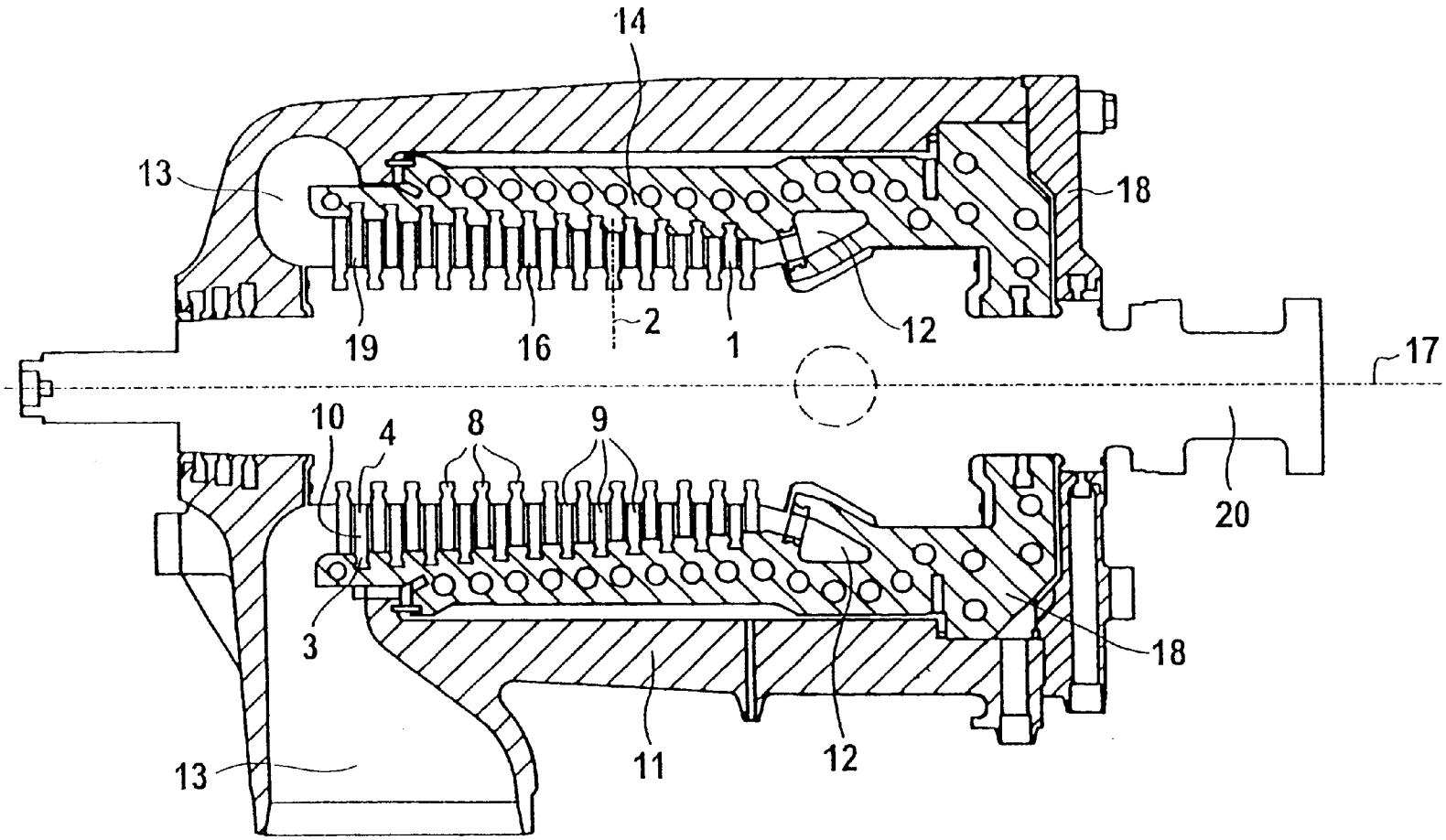
FIG. 1 is a diagrammatic, longitudinal-sectional view of a high-pressure steam turbine.

Referring now in detail to the figures of the drawings, in which the same reference numerals have the same meaning, and first, particularly, to FIG. 1 thereof, there is seen a longitudinal section of a fluid-flow or turbo machine, namely a high-pressure steam turbine 11, which is directed along a turbine axis 17. The steam turbine 11 has a turbine shaft 20, which is directed along the turbine axis 17 and is surrounded by a turbine casing 18. The steam turbine 11 has an inflow region 12 for action fluid in the form of hot steam, as well as an outflow region 13 for the hot steam, along the turbine axis 17. A blading region 14 is provided axially between the inflow region 12 and the outflow region 13. Guide blades 9 and moving blades 8, in each case assembled in a corresponding blade rim 21 shown in FIG. 2, follow one another alternately in the axial direction in the blading region 14. As is seen along a blade axis 2 in FIGS. 1 and 3, each moving blade 8 and each guide blade 9 has a root end region 3, a tip end region 4 and a center region 10 disposed axially between the regions 3 and 4 in the direction of the blade axis 2. Through the use of the root end region 3, a moving blade 8 adjoins the turbine shaft 20 and a guide blade 9 adjoins the turbine casing. The very opposite is the case with the tip end region 4. The moving blades 8 and/or guide blades 9 nearest to the inflow region 12 are in each case constructed as a blade 1 which is inclined and twisted in the root end region 3 and in the tip end region 4. The moving blades 8 and guide blades 9 nearest to the outflow region 13 are in each case constructed as a twisted blade 19 having a twist which increases over the blade axis 2 and a changing cross-sectional profile. Entirely cylindrical blades 16 are disposed axially in the blading region 14 between the inclined and twisted blades 1 and the twisted blades 19. Suction and pressure sides of each of the blades 16 are parallel to the blade axis 2.

Figure 2:
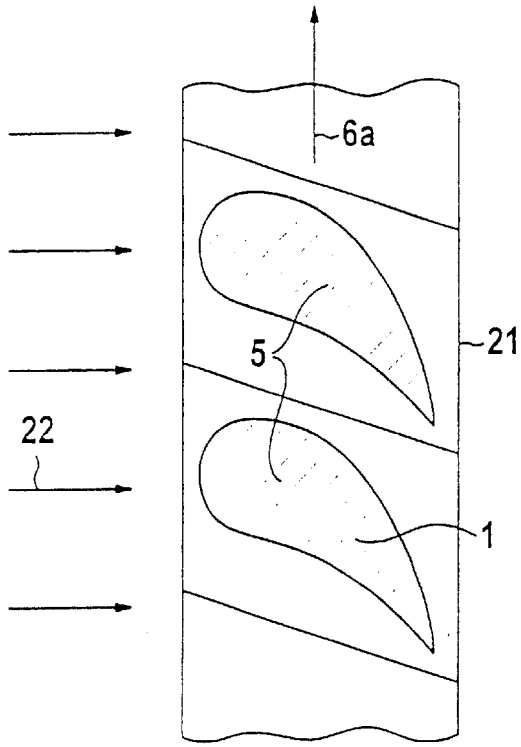
FIG. 2 is a fragmentary, cross-sectional view of a portion of a blade rim.

FIG. 2 shows a portion of the blade rim 21 in which blades 1 are disposed next to one another in circumferential direction 6*a*. For the sake of clarity, the blade rim 21 is developed in the circumferential direction 6*a* and is shown with only two blades 1. The circumferential direction 6*a* corresponds to the circumference of the turbine shaft 20 in a section taken at right angles to the turbine axis 17. A main flow direction 22 of the steam flowing in the steam turbine 11 is at right angles to the circumferential direction 6*a* of the blade rim 21.

Figure 3:
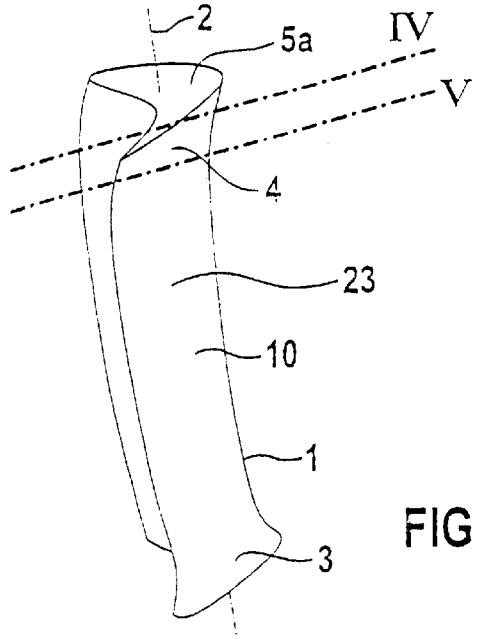
FIG. 3 is a perspective view of a blade or aerofoil region.
Figure 5:
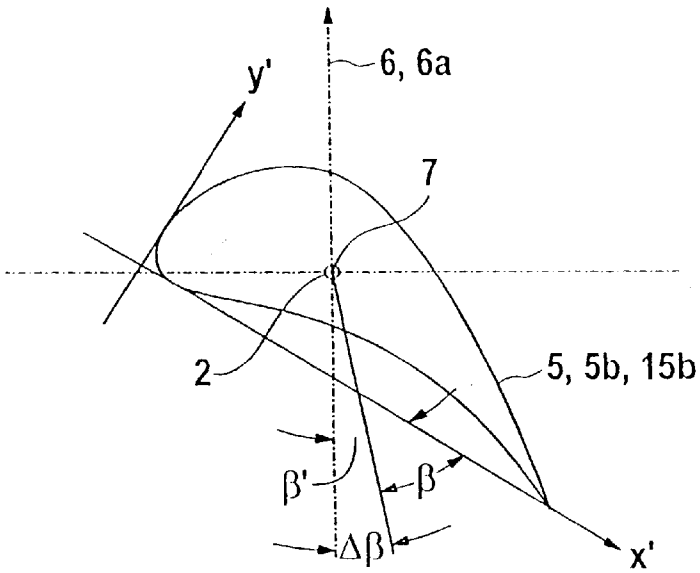
FIG. 5 is a further cross-sectional view of the blade according to FIG. 3, at an axial distance from the cross-section of FIG. 4 in the direction of the blade axis.
Figure 4:
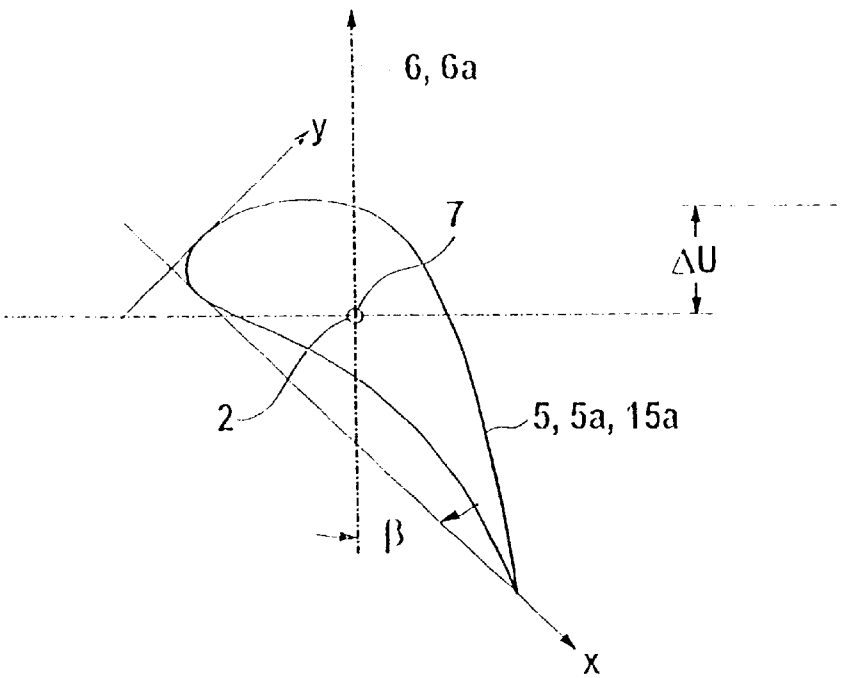
FIG. 4 is a cross-sectional view of the blade or aerofoil region according to FIG. 3.

A blade region or aerofoil region 23 of a blade 1 directed along a blade axis 2 is shown in a three-dimensional representation in FIG. 3. The blade or aerofoil region 23 has a root end region 3, a tip end region 4 and a center region 10 therebetween. A fastening region which adjoins the root end region 3 and with which the turbine blade 1 is fastened in the turbine shaft 20 or the turbine casing 18 is not shown for the sake of clarity. Furthermore, a shroud band, which if need be adjoins the tip end region 4, is likewise not shown. In the tip end region 4 and the root end region 3, the turbine blade 1 is inclined in a cross-sectional direction 6, which preferably corresponds to the circumferential direction 6*a* of the blade rim 21, and is twisted in axial direction by a differential angle $\Delta\beta$, as is seen in FIGS. 4 and 5. The twist increasing in the root end region 3 towards the center region 10 and the increasing circumferential bend correspond to the same twist and circumferential bend as in the tip end region 4. Starting from the root end region 3, this means that, along the blade axis 2, a cross-sectional profile 5 is twisted and displaced in the direction of the center region 10, and the twist and displacement is withdrawn from the center region 10 towards the tip end region 4. The degree of the displacement and twist remains constant over the height of the center region 10. The size of the return twist and return displacement over the tip end region 4 is preferably just as large as the displacement and twist in the root end region 3.

The circumferential bend in this case means a displacement of the cross-sectional profile 5, 5*a* in a cross-sectional direction 6 which preferably corresponds to the circumferential direction 6*a* of a blade rim 21. Twisting of the blade 1 is effected by a stagger-angle change, i.e. a change in an angle β according to FIG. 4 and FIG. 5 by a rotation of the cross-sectional profile 5 about the blade axis 2, which preferably coincides with the gravitational axis of the blade 1. In the case of a blade 1 having a homogeneous mass distribution over a cross-section, this likewise corresponds to a twist about the area center of gravity 7 (mass center of gravity 7) of the cross-sectional profile 5, 5*a*. The cross-sectional profile 5, 5*a*, 5*b* is the same for each cross-section over the entire height of the blade or aerofoil region 23 which means, in particular, that the cross-sectional form and cross-sectional surface are constant. The cross-sectional profile 5*b* shown in FIG. 5 is twisted by the differential angle Δβ and displaced by a displacement value ΔU relative to the cross-sectional profile 5*a* shown in FIG. 4. This corresponds to a change in the stagger angle β to the value of a stagger angle β' shown in FIG. 5.

Since, in a steam turbine, in particular a high-pressure steam turbine, marginal losses, i.e. fluidic losses in the vicinity of the turbine shaft and of the turbine casing, may be up to about 30% of total losses, a reduction in those marginal losses due to the twist and circumferential bend of the blade in a steam turbine leads to an increase in the efficiency. The degree of twist and circumferential bend can be adapted in each case to the fluidic conditions in a steam turbine, in which case the twist and circumferential bend may likewise extend over the entire center region. It is likewise possible for the center region to be entirely cylindrical, i.e. for the suction side and the pressure side of the blade to be directed parallel to the blade axis.

I claim:

1. A blade for a fluid-flow machine, comprising:

a blade axis;

a root end region;

a tip end region disposed opposite said root end region along said blade axis;

a center region disposed between said root end region and said tip end region;

a cross-sectional profile at right angles to said blade axis;

cross-sectional profiles disposed at a distance from one another axially in direction of said blade axis and offset from one another by a translation in a given cross-sectional direction in said tip end region towards said center region;

cross-sectional profiles disposed at a distance from one another axially and offset from one another by a translation in said given cross-sectional direction in said root end region towards said center region;

cross-sectional profiles disposed at a distance from one another axially and twisted relative to one another by a respective differential angle in at least one of said end regions; and cross-sectional profiles disposed at a distance from one another axially and twisted equidirectionally in each of said root end region and said tip end region towards said center region.

2. The blade according to claim 1, including a blade rim having a circumferential direction coinciding locally with said given cross-sectional direction.

3. The blade according to claim 1, wherein said cross-sectional profiles each have a respective area center of gravity and are each twisted relative to said respective area center of gravity.

4. The blade according to claim 1, wherein said cross-sectional profile is identical everywhere along said blade axis.

5. The blade according to claim 1, including a cylindrical structure in said center region.

6. A guide blade or moving blade of a steam turbine, comprising:

a blade axis;

a root end region;

a tip end region disposed opposite said root end region along said blade axis;

a center region disposed between said root end region and said tip end region;

a cross-sectional profile at right angles to said blade axis;

cross-sectional profiles disposed at a distance from one another axially in direction of said blade axis and offset from one another by a translation in a given cross-sectional direction in said tip end region towards said center region;

cross-sectional profiles disposed at a distance from one another axially and offset from one another by a translation in said given cross-sectional direction in said root end region towards said center region;

cross-sectional profiles disposed at a distance from one another axially and twisted relative to one another by a respective differential angle in at least one of said end regions; and cross-sectional profiles disposed at a distance from one another axially and twisted equidirectionally in each of said root end region and said tip end region towards said center region.

7. A steam turbine, comprising:

a turbine axis;

an inflow region;

an outflow region;

a blading region disposed fluidically between said inflow region and said outflow region;

a blade directed along a blade axis and disposed in said blading region, said blade having a root end region, a tip end region, a center region between said end regions, and an inclination and a twist over said blade axis, said inclination and said twist each increasing from said root end region to said center region and decreasing from said center region to said tip end region; and cross-sectional profiles disposed at a distance from one another axially and twisted equidirectionally in each of said root end region and said tip end region towards said center region.

8. The steam turbine according to claim 7, including a blade assigned to said inflow region and having decreasing and increasing inclination and twist.

9. The steam turbine according to claim 8, including a twisted blade assigned to said outflow region.

10. The steam turbine according to claim 9, including an entirely cylindrical blade disposed between said blade and said twisted blade in direction of said turbine axis.

* * * * *